US011659869B2

(12) United States Patent
Fisher et al.

(10) Patent No.: US 11,659,869 B2
(45) Date of Patent: May 30, 2023

(54) METHOD AND SYSTEM FOR ELECTRONIC VAPING OPERATIONS USING SAFETY PROCEDURES

(71) Applicants: OneWorld Solutions Limited, Kowloon Bay (HK); Gary Alan Fisher, Kowloon Bay (HK)

(72) Inventors: Gary Alan Fisher, Kowloon Bay (HK); Alan Pang, Kowloon Bay (HK); Kelvin Choi, Kowloon Bay (HK); Toby Liu, Kowloon Bay (HK)

(73) Assignee: OneWorld Solutions Limited, Kowloon Bay (HK)

( * ) Notice: Subject to any disclaimer, the term of this patent is extended or adjusted under 35 U.S.C. 154(b) by 455 days.

(21) Appl. No.: 16/761,342

(22) PCT Filed: Nov. 14, 2018

(86) PCT No.: PCT/US2018/061084

§ 371 (c)(1),
(2) Date: May 4, 2020

(87) PCT Pub. No.: WO2019/099539

PCT Pub. Date: May 23, 2019

(65) Prior Publication Data

US 2021/0177064 A1 Jun. 17, 2021

Related U.S. Application Data

(60) Provisional application No. 62/585,559, filed on Nov. 14, 2017.

(51) Int. Cl.
*A24F 40/10* (2020.01)
*A24F 40/42* (2020.01)
(Continued)

(52) U.S. Cl.
CPC ..... *A24F 40/53* (2020.01); *A24F 40/42* (2020.01); *A24F 40/51* (2020.01); *A24F 40/57* (2020.01); *A24F 40/90* (2020.01); *A24F 40/10* (2020.01)

(58) Field of Classification Search
CPC ..... A24F 40/10; A24F 40/42; A24F 40/51; A24F 40/53; A24F 40/57; A24F 40/90
See application file for complete search history.

(56) References Cited

U.S. PATENT DOCUMENTS

2014/0270727 A1* 9/2014 Ampolini ..... A24F 40/50 392/394
2015/0359263 A1* 12/2015 Bellinger ..... H05B 1/0244 392/394

(Continued)

OTHER PUBLICATIONS

International Search Report issued in Application No. PCT/US2018/061084, dated Jun. 12, 2019 (3 pages).

(Continued)

*Primary Examiner* — Abdullah A Riyami
*Assistant Examiner* — Thang H Nguyen
(74) *Attorney, Agent, or Firm* — Osha Bergman Watanabe & Burton LLP

(57) ABSTRACT

A method for managing an electronic vaping power device may include performing a safety analysis on a power device circuit. Performing the safety analysis may include using a liquid sensing device to determine whether the liquid is present in the power device circuit. The method may further include disabling, in response to determining that a liquid is present in the power device circuit, the power device circuit from performing the electronic vaping operation or a charging operation.

13 Claims, 9 Drawing Sheets

(51) Int. Cl.

| | |
|---|---|
| ***A24F 40/51*** | (2020.01) |
| ***A24F 40/53*** | (2020.01) |
| ***A24F 40/57*** | (2020.01) |
| ***A24F 40/90*** | (2020.01) |

(56) References Cited

U.S. PATENT DOCUMENTS

| | | | | |
|---|---|---|---|---|
| 2016/0157523 | A1* | 6/2016 | Liu | A61M 15/001 392/395 |
| 2016/0286865 | A1* | 10/2016 | King | H02J 50/10 |
| 2017/0188627 | A1* | 7/2017 | Sur | G01V 3/08 |
| 2017/0245551 | A1* | 8/2017 | Reevell | G01F 23/22 |
| 2017/0258137 | A1* | 9/2017 | Smith | A24F 40/53 |
| 2018/0206557 | A1* | 7/2018 | Peleg | A24F 40/10 |

OTHER PUBLICATIONS

Written Opinion issued in International Application No. PCT/US2018/061084, dated Jun. 12, 2019 (7 pages).

* cited by examiner

METHOD AND SYSTEM FOR ELECTRONIC VAPING OPERATIONS USING SAFETY PROCEDURES

CROSS-REFERENCE TO RELATED APPLICATIONS

This application claims priority to U.S. Provisional Patent Application Ser. No. 62/585,559, titled "Circuit Protection Systems for Electronic Vapor Products", which was filed on Nov. 14, 2017, and is incorporated herein by reference in its entirety.

BACKGROUND

Electronic devices may enable a user to inhale vapor through a mouth in a manner similar to traditional cigarette smoking. These electronic devices may be battery-operated electronic devices sold to consumers in connection with attachable cartridges. For example, the electronic devices may be capable of vaporizing a liquid within the cartridge.

SUMMARY

In general, in one aspect, embodiments relate to a system that includes a power device circuit. The system further includes a power source coupled to the power device circuit. The system further includes a liquid sensing device coupled to the power device circuit. The system further includes a processing system coupled to the power source, the liquid sensing device, and the power device circuit. The processing system controls heating element power using the power source. The heating element power operates a heating element in an electronic vaping cartridge. The liquid sensing device transmits a liquid sensing signal to the processing system in response to determining that a liquid is present in the power device circuit.

In general, in one aspect, embodiments relate to an electronic vaping power device that includes a power source. The electronic vaping power device includes a power device circuit coupled to the power source. The power device circuit performs an electronic vaping operation. The electronic vaping power device further includes a processing system coupled to the power source and the power device circuit. The electronic vaping power device performs a safety analysis on the power device circuit. The safety analysis includes using a liquid sensing device to determine whether a liquid is present in the power device circuit. The electronic vaping power device further disabling, in response to determining that the liquid is present in the power device circuit, the power device circuit from performing the electronic vaping or charging operations.

In general, in one aspect, embodiments relate to a method for managing an electronic vaping power device. The method includes performing a safety analysis on a power device circuit. Performing the safety analysis includes using a liquid sensing device to determine whether a liquid is present in the power device circuit. The power device circuit performs an electronic vaping operation. The method further includes disabling, in response to determining that the liquid is present in the power device circuit, the power device circuit from performing the electronic vaping or charging operations.

Other aspects of the invention will be apparent from the following description and the appended claims.

DETAILED DESCRIPTION

Figure 1:
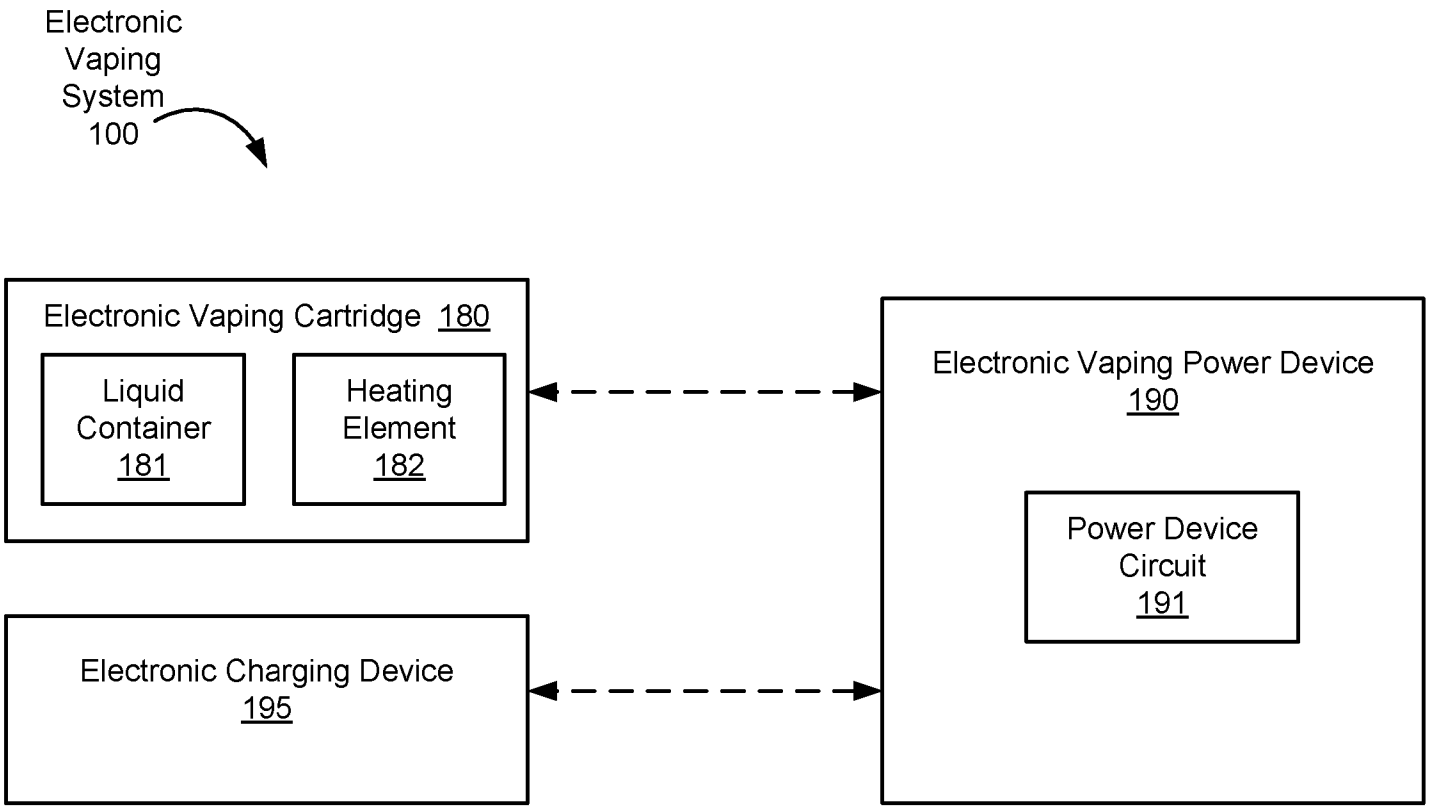
FIGS. 1, 2, and 3 show systems in accordance with one or more embodiments.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the invention include a system, an apparatus, and a method for detecting faults such as anomalies and/or failures of electronic vaping power devices. In particular, faults may include one or more malfunctioning components within an electronic vaping power device. Moreover, faults may also include one or more unsatisfactory operating conditions in regard to the power device. For example, an ambient temperature of the power device outside a safe operating condition range may be a fault. Current leakage within a printed circuit board may also be a fault. Thus, various embodiments may be directed toward identifying temporary and/or permanent faults within an electronic vaping system, while also temporarily or permanently disabling a power device in response to identification of one or more faults.

Where a fault is detected by a processing system in an electronic vaping power device, the processing system may temporarily or permanently terminate operations. If the fault can be diagnosed and fixed by the processing system, operations may resume after the fault is eliminated. If the source of the fault cannot be identified or cannot be fixed within the electronic vaping power device, the processing system may initiate a "kill" mode that permanently disables the device, e.g., bricks the device such that a user cannot use the device for electronic vaping operations. For example, a thermal cut-off device or a protection circuit may be implemented in the power device such to provide temporary or permanent disabling of the power device.

Furthermore, faults in an electronic vaping power device are generally hard to diagnose. In particular, a common problem in electronic vaping power devices is identifying sources of excessive heat by a heating element or other components while a power device is at rest or during electronic vaping operations. This excessive heating may result in the generation of known carcinogens, for example. Likewise, dangerous temperatures may cause injury to the user if located on a device's surface. Other faults may include short circuits resulting from liquid entering a device's housing, e.g., a user exhaling vapor back into the device or immersing the device in water.

In view of the above, one or more embodiments incorporate various sensing techniques that perform safety analyses on an electronic vaping power device. For example, liquid sensing devices in the device may detect water or other liquids contacting a circuit within the device. Temperature sensing devices may detect individual temperature changes to electronic components in the device as well as provide an estimate of the ambient temperature of the device. Current sensing devices placed throughout an electronic vaping power device may identify potential current leakage in the power device, an electronic vaping cartridge, or an electronic charging device.

Moreover, electronic vaping operations may include various types of vaping embodiments with respect to an electronic vaping cartridge. For example, in some embodiments, an electronic vaping cartridge includes a liquid with a substance that includes a flavor package and nicotine. An electronic vaping power device may vaporize the liquid using a heating element during electronic vaping operations.

In another embodiment, an electronic vaping cartridge includes a substance that is heated by the electronic vaping power device using a heating element or chamber. For example, the substance may include tobacco, herb(s), and/or other types of flavored materials. Thus, a heat-not-burn technology may be used, where the substance is heated to a predetermined temperature below the charring temperature of the substance during an electronic vaping operation to produce vapor for inhalation by a user.

In another embodiment, an electronic vaping cartridge includes a liquid coupled to an substance. For example, the substance may include tobacco, herb(s), and/or other types of flavored materials. An electronic vaping power device may vaporize using a heating element the liquid into a vapor that passes over the substance during electronic vaping operations. The vapor may be accordingly inhaled by a user.

FIG. 1 shows a block diagram of a system in accordance with one or more embodiments. In one or more embodiments, as shown in FIG. 1, an electronic vaping system (100) includes an electronic vaping power device (190). In particular, the electronic vaping power device (190) may be connected to an electronic vaping cartridge (180) to form an electronic cigarette or e-cigarette. For example, an electronic cigarette may be a handheld device that simulates one or more feelings of smoking by generating a vapor using liquid in an electronic vaping cartridge. For example, the electronic vaping power device may generate the vapor during an electronic vaping operation where a user inhales the vapor.

Furthermore, the electronic vaping power device (190) may be hardware and/or software that implements a power control system with functionality to monitor and control various electrical signals (e.g., electric charging signal (201), heating element power (202), sensing signals, etc.) during an electronic vaping operation and other device modes, such as a sleeping mode or protection mode. For information on the different types of electrical signals associated with an electronic vaping power device, see FIGS. 2 and 3 below and the accompanying description. Moreover, the electronic vaping power device (190) may include a circuit (e.g., power device circuit (191)) that includes functionality for operating one or more components within the electronic vaping power device (190). For example, a power device circuit (191) may be a printed circuit board with one or more integrated circuits coupled to a processing system on the printed circuit board. While a single power device circuit (191) is shown inside the electronic vaping power device (190) in FIG. 1, a combination of two or more individual circuit may be used instead.

Keeping with FIG. 1, the electronic vaping power device (190) may be connected to an electronic vaping cartridge (180) (e.g. dotted arrows) to send and/or receive control signals, feedback response controls, and/or supply power source signals. Specifically, the electronic vaping power device (190) may transmit electrical power (e.g., a heating element power (202)) that triggers heating of a liquid inside a liquid container (181). In particular, the liquid container may be heated by operation of one or more heating elements (e.g., heating element (182)) located inside the electronic vaping cartridge (180). Thus, the electronic vaping power device may control the heating element (182) by focusing energy in the form of heat on the liquid container (181). The liquid container (181) is assembled to manage the spread of heat from the heating element (182) inside the electronic vaping cartridge (180). For example, the liquid container (181) may be formed around the heating element (182) in such a way as to have any circuit device in the electronic vaping cartridge and the heating element (182) fully or partially embedded inside the liquid container (181).

Continuing with the electronic vaping cartridge (180) of FIG. 1, in one or more embodiments, the electronic vaping power device (190) provides the electronic vaping cartridge (180) with instructions that operate the heating element (182). In such event, the vaping power device (190) may transfer instructions in advance to the electronic vaping cartridge (180) to adjust one or more settings in a programmable element inside the electronic vaping cartridge (180). The electronic vaping power device (190) may receive feedback from the electronic vaping cartridge (180). In one or more embodiments, the vaping power device (190) transfers instructions in real-time to the electronic vaping cartridge (180) based on any feedback received from the liquid container (181) and/or the heating element (182). For example, the electronic vaping cartridge (180) may contain e-liquid, a heating coil wrapped around a wick, a substrate and a mouth piece. The mouth piece may include one or more ventilation ducts. Thus, e-liquid in the electronic vaping cartridge (180) may vaporize when current flows through the heating element.

Furthermore, in one or more embodiments, the heating element (182) generates heat using an external power source such as power source (260) described in detail with reference to FIG. 2. In such event, the electronic vaping power device (190) may control and/or monitor possible failures between the heating element (182) and the power source (260) as well as possible anomalies and failures between the power device circuit (191) and the power source.

Keeping with FIG. 1, in one or more embodiments, the electronic vaping power device (190) may be connected to an electronic charging device (195). The electronic charging device (195) may include one or more individual circuit devices that enable the electronic charging device (195) to receive, store, and/or supply an electric current (e.g., electric charging signal (201) in FIG. 2) to the electronic vaping power device (190). Specifically, the electronic charging device (195) may regulate power distributed to the electronic vaping power device (190) from a power source external to the electronic vaping power device (190). For example, the electronic vaping power device (190) may monitor the stability of a power source (e.g., power source (260) in FIG. 2) internal to the electronic charging device (195) by determining a rate of supply of electric current, determining a rate of charge of the power source, and/or designating a predetermined current flow based on a comparison of the rate of supply with the rate of charge. Likewise, the electronic vaping power device may control current flow to the power source by instructing the electronic charging device (195) to regulate the power source by limiting or restricting power transfer from the internal power source to the electronic vaping power device (190).

Furthermore, the electronic charging device (195) may transfer power to the electronic vaping power device (190) based on instructions obtained from the electronic vaping power device (190). For example, the instructions may describe the transmission of electric current as well as requesting feedback parameters to regulate current flow to the power device circuit (191).

Figure 2:
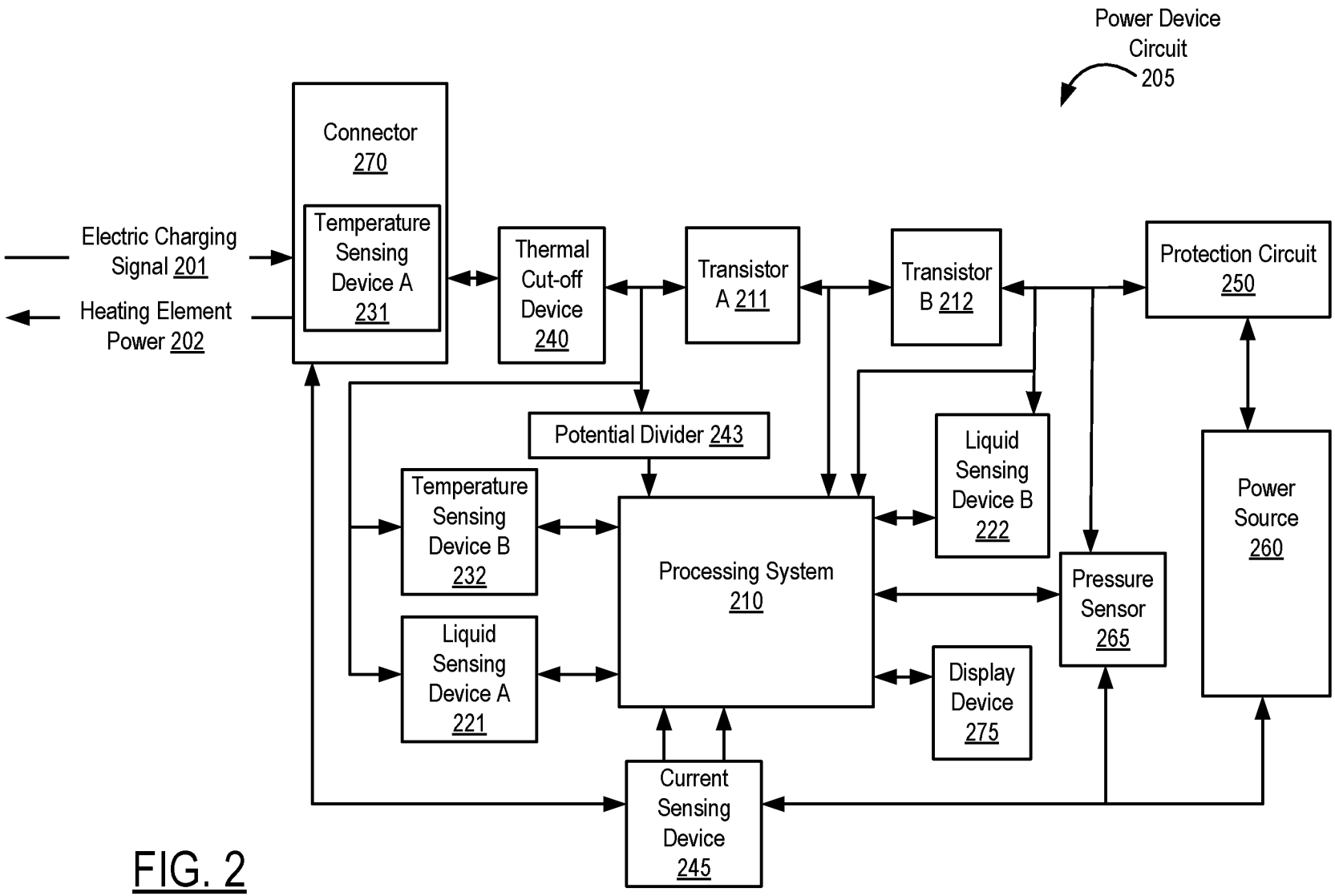

Turning to FIG. 2, FIG. 2 shows a block diagram of a system in accordance with one or more embodiments. In one or more embodiments, as shown in FIG. 2, a power device circuit (205) includes hardware and/or software for detecting anomalies and/or failures during an electronic vaping operation or other modes of an electronic vaping power device. For example, the power device circuit (205) may include a potential divider (243), processing system (210), a connector (270), one or more temperature sensing devices (e.g., a temperature sensing device A (231), temperature sensing device B (232)), one or more liquid sensing devices (e.g., a liquid sensing device A (221), a liquid sensing device B (222)), a thermal cut-off device (240), one or more transistors (e.g., a transistor A (211), a transistor B (212)), a current sensing device (245), a protection circuit (250), a power source (260), a pressure sensor (265), and/or a display device (275).

Furthermore, in one or more embodiments, the processing system (210) may control one or more electric signals (e.g., an electric charging signal (201), heating element power (202)) within the power device circuit (205). In particular, the processing system (210) may include a constant power control function that controls power transfer to the heating element (182) by monitoring an instant feedback of current/voltage delivered. These electric signals may include commands, instructions, and/or triggers, e.g., control signal (301), for the monitoring or controlling of the overall electronic vaping system (100). Furthermore, the processing system (210) may be one or more integrated circuits. For example, the processing system may be one or more cores or micro-cores of a processor. The processing system (210) may also include one or more input devices, such as a transmitter, receiver, Bluetooth module, resistors, capacitors, inductors, or any other type of input device. These inputs may transmit signals to the processing system (210) using general input/output ports, analog ports, or dedicated ports configured to receive only one type of signal or pattern (e.g. input ports configured to receive analog signals such as analog-to-digital convertors (ADC) or output ports configured to send digital signals such using digital-to-analog convertors (DAC). For more information on the processing system, see FIG. 3 and the accompanying description.

In one or more embodiments, a transistor (e.g., transistor A (211), the transistor B (212)) is coupled to the processing system (210) to produce a switch effect. In particular, a transistor may include hardware with functionality to regulate current flow within the power device circuit (205), e.g., between the processing system (210) and the thermal cut-off device (240) and/or the protection circuit (250). Depending on current requirements established by the power source (260) and/or the processing system (210), transistors may be located in such a position as to provide protection to one or more components in the event of a fault in the power device circuit (205). In one or more embodiments, a transistor triggers a safety procedure depending on whether the transistor is "open" or "closed." In one embodiment, for example, the transistor is disposed between the thermal cut-off device (240) and the processing system (210).

In one or more embodiments, the processing system (210), when activated, may sample current using a current sensing device (245).

Furthermore, in one or more embodiments, transistors in the power device circuit (205) may include a rectifier diode and a transistor, one or more field effect transistors, a combination of bipolar junction transistors, Darlington transistors, and/or a combination of semi conductive material capable of supplying a large changing output signal based on small variations in a small input signal. In one or more embodiments, the transistor A and transistor B may be, for example, current controlled devices, voltage controlled devices, or a combination of both.

Keeping up with FIG. 2, in one or more embodiments, a liquid sensing device (e.g., liquid sensing device A (221), the liquid sensing device B (222)) is coupled to the processing system (210). In particular, with a liquid sensing device may provide information indicative of the presence of liquid inside the electronic vaping system (100). For example, the liquid sensing device may include hardware and/or software that includes functionality to determine a signal indicative of the presence of liquid near prioritized electronic parts, such as the power device circuit (205). For example, a liquid sensing device may include various open-circuited conductive traces coupled to an amplifier. When a liquid proximate the open-circuited conductive traces produces a closed circuit among the conductive traces, a current may flow through the traces to an input of an amplifier. Thus, the amplifier may obtain current passing through the closed circuit and convert the current into a voltage, (e.g., a signal identifying the presence of a liquid between the conductive traces to a processing system).

In one or more embodiments, one or more liquid sensing devices are disposed to determine moisture levels inside the electronic vaping system (100). In one or more embodiments, the liquid sensing device supplies a signal (e.g., a liquid sensing signal A (304), a liquid sensing signal B (305)) indicative of moisture levels inside the electronic vaping system (100). For example, a sensing signal may be a differential signal describing a voltage difference across a resistor. In one or more embodiments, the moisture levels are specific to a section of the electronic vaping device (100). As such, the processing system (210) may identify a moisture at a specific location inside the electronic vaping system (100) based on which liquid sensing device detects the moisture.

Furthermore, in one or more embodiments, the liquid sensing device may be an electronic device capable of evaluating humidity in a closed environment, one or more wires coated to react with moisture, and/or a combination of software and hardware. For example, a liquid sensing device may be a wire covered by a material that dissolved in contact with a liquid.

In some embodiments, other types of liquid sensing devices are contemplated. For example, a liquid sensing device may include a combination of transistors, resistors, diodes, such as an InGaAsP semiconductor laser diode, photoelectric switches, integrated circuits, and/or other circuit components. Thus, various circuit combinations may be implemented within a power device circuit to generate a liquid sensing signal that indicates the presence or absence of a liquid in a power device.

In one or more embodiments, a temperature sensing device (e.g., one or both of the temperature sensing device A (231) and the temperature sensing device B (232)) is coupled to the processing system (210) to provide the processing system (210) with information indicative of a value of temperature inside the electronic vaping system (100). In particular, the temperature sensing device may be hardware and/or software that includes functionality to determine an electric signal (e.g., temperature sensing signal (303)) indicative of a temperature value. In one or more embodiments, a temperature sensing device may be disposed in an electronic vaping power device as to measure the presence of specific temperatures near various electronic components or parts of a power device, such as the current sensing device (245), the connector (270), the protection unit (250), and/or the pressure sensor (265). In one or more embodiments, one or more temperature sensing devices are disposed to determine temperature levels inside the electronic vaping system (100) and/or inside a specific electronic part, such as the connector (270). The temperature sensing devices being configured to collect heat data or being configured to enable a trigger to alert the processing system (210) of the presence of various predetermined temperatures inside the electronic vaping system (100). In one or more embodiments, the temperature sensing device supplies a continuous signal indicative of evaluated temperature levels inside the electronic vaping system (100). In one or more embodiments, the temperature levels are specific to a section of the electronic vaping device (100). As such, the temperature sensing device may additionally supply the processing system (210) with information relating to a location where a temperature of interest (e.g., too high or too low). Likewise, temperature sensing devices may identify the average ambient temperature of an electronic vaping power device or individual temperatures of various electronic components.

Furthermore, in one or more embodiments, the temperature sensing device is made of a material capable of changing according to a temperature proximate the material. In one or more embodiments, the temperature sensing device may change a physical property based on a change of temperature. For example, the temperature sensing device may be a thermistor, a digital temperature reader, a thermocouple, and/or a tempsistor. In one or more embodiments, the temperature sensing device may provide an analog and/or digital output specifying a temperature change.

In one or more embodiments, a thermal cut-off device (240) is coupled to a temperature sensing device inside the power device circuit (205). In particular, the thermal cut-off device may be hardware and/or software that includes functionality to produce an open-circuit based on various thermal changes surrounding the device. For example, depending on a thermal range and a location of the thermal cut-off device (240) inside the power device circuit (205), the thermal cut-off device (240) may open when a predetermined cut-off temperature is reached. For example, the thermal cut-off device (240) may be a reusable thermal fuse or a thermal diode responsive to sudden changes in temperature. Likewise, the thermal cut-off device may close when the temperature drops below the predetermined cut-off temperature and/or the processing system resets the thermal cut-off device (240). In one or more embodiments, the thermal cut-off device is placed adjacent to a heat source so as to be tuned to change immediately upon a change in surrounding temperature. In some embodiments, the thermal cut-off device (240) may terminate transmission of heating element power between a heating element and the power source (260) to prevent over heating by an electronic vaping system.

In one or more embodiments, a current sensing device (245) is coupled to the processing system (210) in the power device circuit (205) to produce a signal indicative of a current leakage within an electronic vaping power device. In particular, the current sensing device (245) may be hardware and/or software that includes functionality to evaluate two or more current values disposed in series on the line with the current flow access to a supply power (260) disposed inside the power device circuit. For example, depending on the difference in current or voltage values evaluated by the processing system (210), the processing system (210) may cause the current sensing device (245) to determine a value for leaked voltage or current. In such event, for example, the processing system (210) may address the leaked voltage, e.g., by momentarily, or permanently, deactivating one or more components in the electronic vaping power device.

In one or more embodiments, a power source (260) is coupled to a protection circuit (260) and a pressure sensor (265). For example, the protection circuit (260) may include hardware with functionality for permanently and/or temporarily disabling a power device circuit (205) in response to a signal from a processing system (210). Moreover, the pressure sensor (265) may be hardware and/or software with functionality to detect a pressure input applied by a user to a power device. For example, the pressure sensor (265) may produce a signal in response to a pressure input that initiates electronic vaping operations.

Furthermore, the protection circuit (250) may provide analog and/or digital protection to the power device circuit. In particular, the protection circuit (250) may terminate an electrical connection to the power source (260) when a current surge cannot be controlled. Similarly, the protection circuit (250) may be instructed to terminate the electrical connection by the processing system (210) directly (e.g., using a power source control signal (302), or through another electronic element in the power device circuit (250)). In such event, the protection circuit (250) may limit the exposure of the power source (260) to the point of minimizing damage and increasing the power source's life.

In one or more embodiments, a display device (275) is coupled to the processing system (210) to supply a feedback response based on instructions received by the processing system (210). In particular, in one or more embodiments, the processing system updates the display device in real-time to provide current statistics extracted from the several sensing devices coupled to the processing system (210). In one or more embodiments, the display device (275) is a string of light emitting diodes (LEDs), a touchscreen, and/or a liquid crystal display (LCD). As such, the display device (275) is any visual aid capable of changing in real-time, or upon a requested update entry, and where the visual aid may be used to interface with any hardware or software attributes of the electronic vaping system. For example, visual aids for various electronic vaping operations may include: a white light responsive to a successful puffing function, three red and white light flashes responsive to puffing is attempted without a cartridge attached in the system; three red light flashes responsive to low battery voltage while puffing; six red light flashes responsive to an over battery life span; ten red flashes responsive to detecting leakage current/voltage; and/or a continuous red flash responsive to leakage current/voltage.

In one or more embodiments, an electronic vaping power device includes a connector (e.g., connector (270)). For example, a connector may be a physical connection port on an electronic vaping power device or power device circuit (e.g., power device circuit (205)). The connector may be configured to mechanically or magnetically attach an electronic vaping power device with one or more individual circuit devices located outside of the power device. For example, a connection port may be coupled to a communication module that includes a receiver and a transmitter that allows the power device circuit (205) to connect and communicate wirelessly with one or more individual circuit devices outside of the electronic vaping power device (205). The connection port may expand the detecting capabilities of the electronic vaping power device by enabling the electronic vaping power device to regulate and/or terminate operation of electronic vaping system temporarily or permanently.

In one or more embodiments, for example, a connector (270) is a gateway for information received and transferred from/to a power device circuit. In particular, the connector (270) may include one or more temporary physical connections associated with the power device circuit (205). For example, in the area of electronic vaping systems, there may be two or more connections, disposed around the electronic vaping system as to provide accessible ports to interface with the power source for charging, the processing system for updating, and the/or the heating element of an electronic vaping cartridge.

Figure 3:
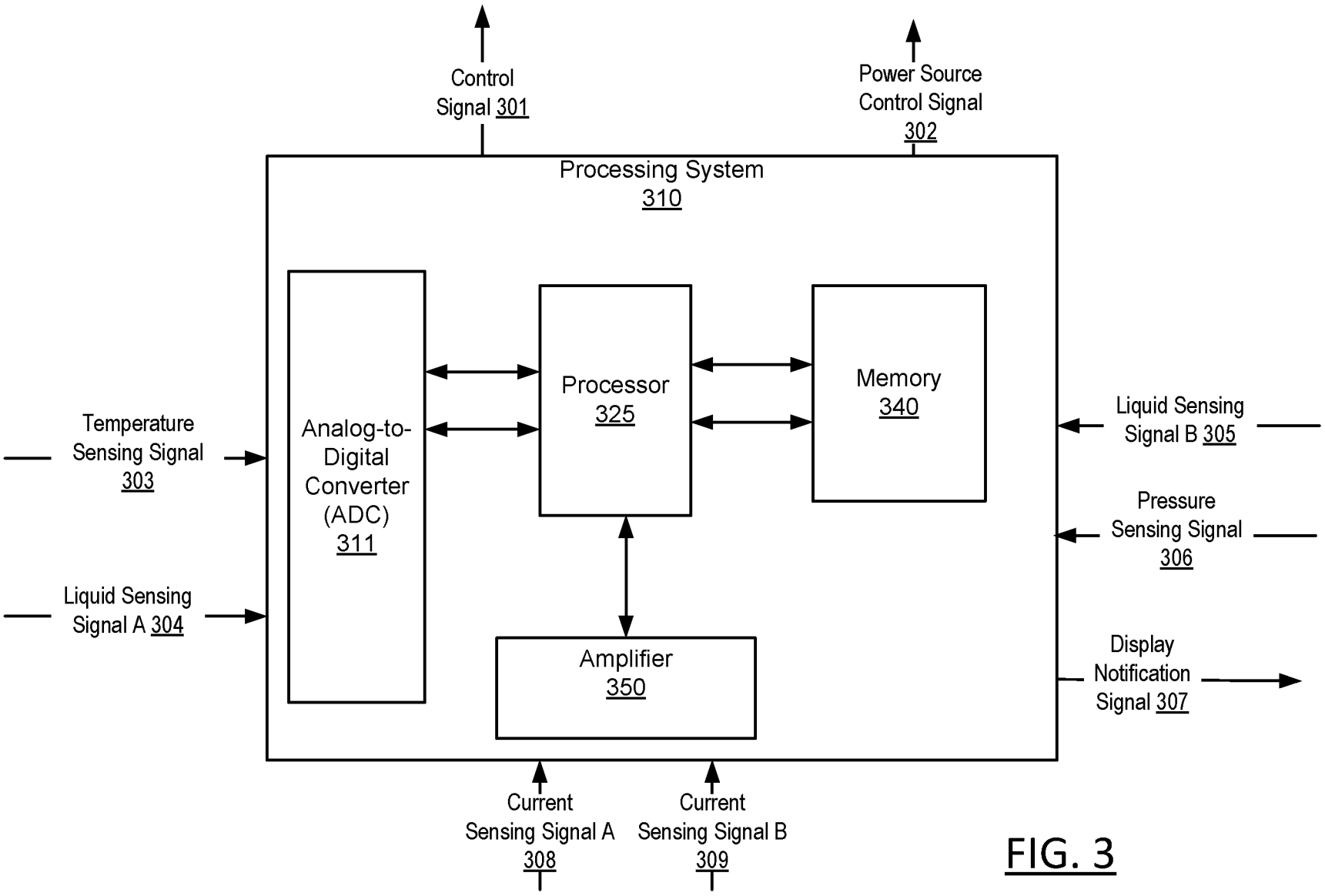

Turning to FIG. 3, FIG. 3 shows a block diagram of a system in accordance with one or more embodiments. In one or more embodiments, as shown in FIG. 3, a processing system (310) includes an analog-to-digital converter (ADC) (311), a processor (325), an amplifier (350) and a memory (340). Furthermore, one or more components illustrated in FIG. 3 may be similar to one or more components described in FIGS. 1 and/or 2, and the accompanying description (e.g., the processing system (210) may be similar to processing system (310), etc.).

In one or more embodiments, the ADC (311) is operably connected to the processor (325). The ADC may include hardware and/or software that converts analog signals into number strings to be evaluated by the processor (325) (e.g., a temperature sensing signal into a temperature value). The temperature sensing signal, current sensing signal, and the pressure sensing signal, may be supplied continuously to the ADC from each side of the electronic vaping system.

In one or more embodiments, the amplifier (350) is serially connected to the processor (325) in a linear computational scheme. According to one or more embodiments, the amplifier (350) may be disposed in proximity to one or more resistors. For example, the amplifier (350) may be a combination of transistor, resistors, capacitors, and/or inductors capable of providing an active and/or passive gain. Such gain may be defined by the non-transient and/or transient properties in of the amplifier (350). In one or more embodiments, for example, one or more current signals (e.g., current sensing signal A (308), current sensing signal B (309)) supply a continuous string of current values representative of a voltage and current leakage. The amplifier (350) may enlarge the string of values and normalize the string of values to extrapolate voltage and current leakage parameters. The voltage and current leakage parameters are transferred to the processor where the processor may receive and store these parameters in relation to a priority order. In one or more embodiments, the memory (340) is coupled to the processor (325). In one or more embodiments, for example, the signals received by the processor from the ADC, the amplifier, and any exterior media, are stored in memory (340).

In one or more embodiments, the processing system is directly linked, or coupled, with outside devices. These devices may include peripherals capable of providing extra safety layers to the electronic vaping system. These peripherals may include the power source, the connector, and/or the display device. In one or more embodiments, for example, the processor interprets signals received through the connector, the display device (e.g., in the form of feedback response), and the power source to control and monitor the status of the systems supplying information to the ADC (311) and the amplifier (350). For example, as it will be described in using FIGS. 4 and 5, power to the processing system (310) may be terminated. In such event, in one or more embodiments, the processor instructs the data received from various peripherals to be stored in memory, and signal one or more reasons for shutdown on the display device before performing the ultimate shutdown.

Returning to FIG. 1, in one or more embodiments, the electronic vaping cartridge (180) may further include one or more individual circuit devices that enable the electronic vaping cartridge (180) to operate the heating element (182). For example, the heating element (182) may include a thermal conductor (not shown) regulated using electronics or software to heat at a specific location within the electronic vaping cartridge (180). The thermal conductor may be a material layered on an existing electronic device inside the electronic vaping cartridge (180). In such event, the heating element (182) may be disposed as to face in a specific direction with respect to the electronic vaping power device so as to cover a portion of a transversal area of the electronic vaping power device. Likewise, the heating element may be radially disposed on the electronic vaping power device to form a coverage ring that provides uniform heat to the electronic vaping cartridge (180). Furthermore, in one or more embodiments, the heating element (182) is embedded in an insulating material that generally contains heat generated by the heating element (182) and maintains exposed surfaces of the electronic vaping cartridge (180) at a predetermined temperature.

In one or more embodiments, the heating element (181) generates heat using power obtained from an internal power source (not shown). The electronic vaping power device (190) monitors and controls the internal power source in addition to the heating element (182). The electronic vaping power device (190) may send and receive instructions and feedback from both the power source and the heating element (182) individually, as well as sending and receiving instructions about each other. For example, the heating element (181) may receive power from a voltage regulator (not shown) or a battery (not shown) disposed inside the electronic vaping cartridge (180). In such event, the electronic vaping power device (190) controls a real-time current supply from the power source to the heating element (182). The electronic vaping power device (190) monitors the power source in search of possible power transmission anomalies or failures. Furthermore, the liquid container (181) and the heating element (182) may be enclosed in two distinct portions of the electronic vaping cartridge (180). In such event, the liquid container (181) may be separated into an impermeable portion different from the portion that contains the power source to reduce a possibility of liquid leakage-induced failures.

While FIGS. 1-3 show various configurations of components, other configurations may be used without departing from the scope of the invention. For example, various components may be combined to create a single component. As another example, the functionality performed by a single component may be performed by two or more components. Accordingly, for at least the above-recited reasons, embodiments of the invention should not be considered limited to the specific arrangements of components and/or elements shown in FIGS. 1-3.

Figure 4:
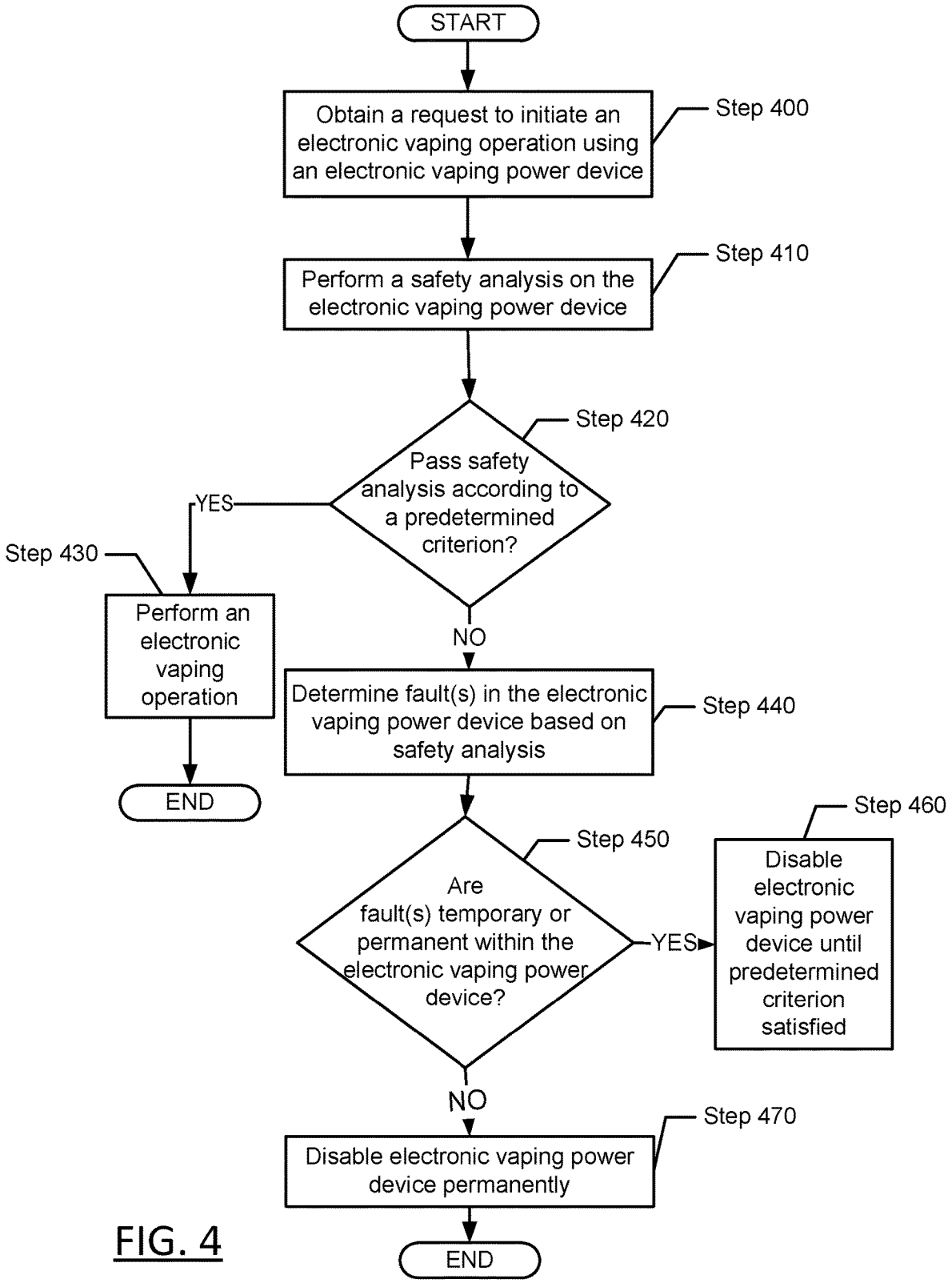
FIGS. 4 and 5 show flowcharts in accordance with one or more embodiments.

Turning to FIG. 4, FIG. 4 shows a flowchart in accordance with one or more embodiments. Specifically, FIG. 4 describes a method for performing one or more safety procedures in regard to electronic vaping operations and/or power device modes. The process shown in FIG. 4 may involve, for example, one or more components discussed above in reference to FIGS. 1-3 (e.g., processing system (210)). While the various steps in this flowchart are presented and described sequentially, one of ordinary skill in the art will appreciate that some or all of the steps may be executed in different orders, may be combined or omitted, and some or all of the steps may be executed in parallel. Furthermore, the steps may be performed actively or passively.

In Step 400, a request to initiate an electronic vaping operation is obtained using an electronic vaping power device in accordance with one or more embodiments. As such, a request may correspond to a signal generated in response to a user input to the electronic vaping power device. For example, the request may be triggered by a pressure sensor disposed on the electronic vaping power device. On the other hand, the request may be triggered by a switch, a button, or an input to one or more touch pads. In one or more embodiments, the electronic vaping operation corresponds to a start of a normal puffing operation by a user. In particular, a normal puffing operation may involve puffing through the cartridge mouth piece to create a pressure difference on the power unit pressure sensor diaphragm, if the difference meets a predetermined pressure sensor level, the pressure sensor may output a signal to the processing system.

In Step 410, a safety analysis is performed on an electronic vaping power device in accordance with one or more embodiments. Specifically, the electronic vaping system may determine whether the power device circuit can be operated within one or more predetermined criteria. The electronic power system may internally determine a number of safety analyses to perform. For example, safety analyses may be managed by the processing system inside a power device circuit. Likewise, these safety analyses may correspond to a number of redundant operations established to identify and/or prevent faults from occurring during electronic vaping operations. For example, safety analyses may include evaluating temperatures throughout an electronic vaping system, sampling voltages from various sensing signals, e.g., temperature sensing signals, liquid sensing signals, etc.

Turning to FIGS. 6-9, FIGS. 6-9 provide examples of various safety analyses performed in an electronic vaping system. The following examples are for explanatory purposes only and not intended to limit the scope of the disclosure.

Figure 6:
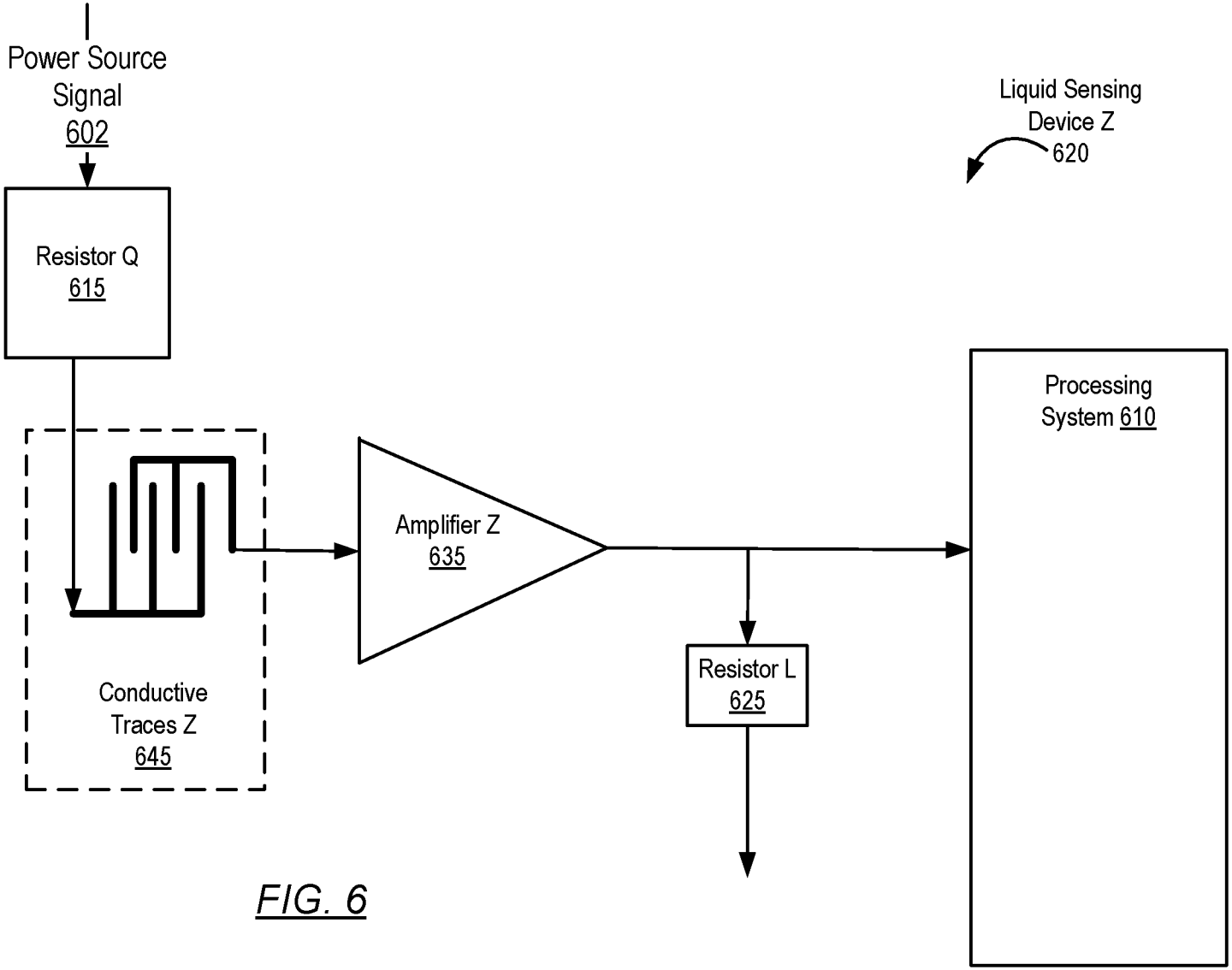
FIGS. 6, 7, 8, and 9 show examples in accordance with one or more embodiments.

Turning to FIG. 6, FIG. 6 shows an example of a liquid sensing device in accordance with one or more embodiments. For example, as shown in FIG. 6, a liquid sensing device Z (620) may include a processing system (610), a resistor Q (615) that obtains a power source signal (602), an arrangement of conductive traces Z (645) (e.g., wired or freestanding sections of conductive material prepared to react to a liquid), an amplifier Z (635) (e.g., a signal differential device or one or more electronic components arranged to output a comparable gain), and a resistor L (625). In particular, the conductive traces Z (645) are configured to be in an open-circuit state. When liquid contacts the conductive traces Z (645), one or more adjacent conductive traces may conduct to form a closed circuit enabling current from the power source signal (602) to flow across the resistor Q (615) to an input of the amplifier Z (635). Based on the number of closed circuits produced by the liquid, different amounts of current may flow to the amplifier Z (635) resulting in different output voltages in a liquid sensing signal. Based on the liquid sensing signal, the processing system (610) may detect liquid present in an electronic vaping power device or electronic vaping system. Accordingly, when no liquid is proximate the conductive traces Z (645), the voltage output of the amplifier Z (635) is approximately zero.

Figure 7:
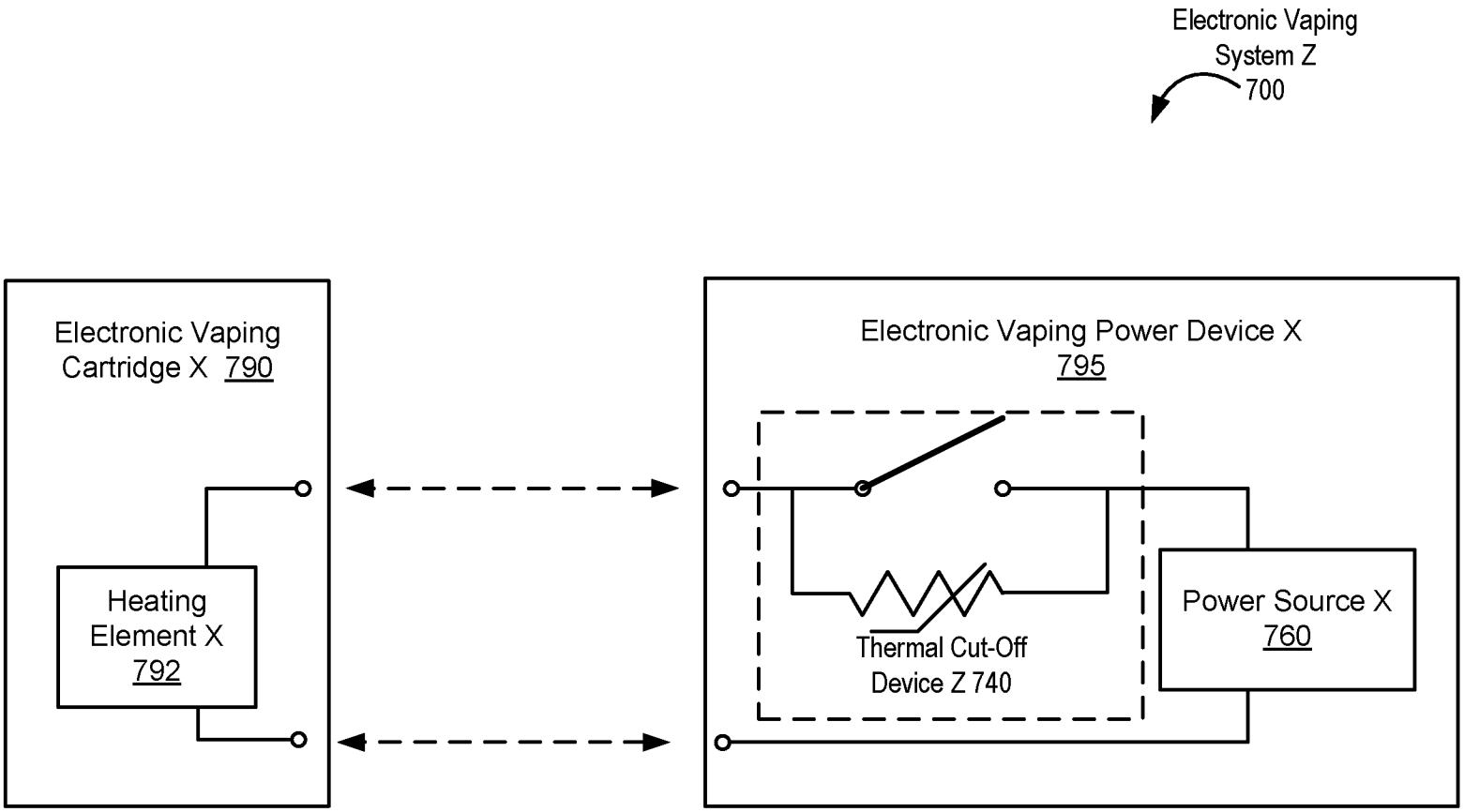

Turning to FIG. 7, FIG. 7 shows an example of a thermal cut-off device in accordance with one or more embodiments. For example, as shown in FIG. 7, a thermal cut-off device Z (740) is located in an electronic vaping system Z (700), where the thermal cut-off device Z (740) is coupled to a power source X (760) and a heating element X (792) in an electronic vaping cartridge X (790). In particular, the thermal cut-off device Z (740) may include a positive temperature coefficient (PTC) and bimetallic switch, where the switch opens in response to the electronic vaping system Z (700) reaching a predetermined cut-off temperature. Thus, when an electronic vaping power device X (795) is connected to an electronic vaping cartridge X (790), the thermal cut-off device Z (740) can terminate heating element power when the electronic vaping system Z (700) reaches the predetermined cut-off temperature. Likewise, the switch in the thermal cut-off device Z (740) may close when the temperature of the electronic vaping system Z (700) falls below the predetermined cut-off temperature. In another example, a processing system (not shown) may control the switch in the thermal cut-off device Z (740), and the processing system may close the switch after the electronic vaping system Z (700) satisfies one or more safety analyses.

Figure 8:
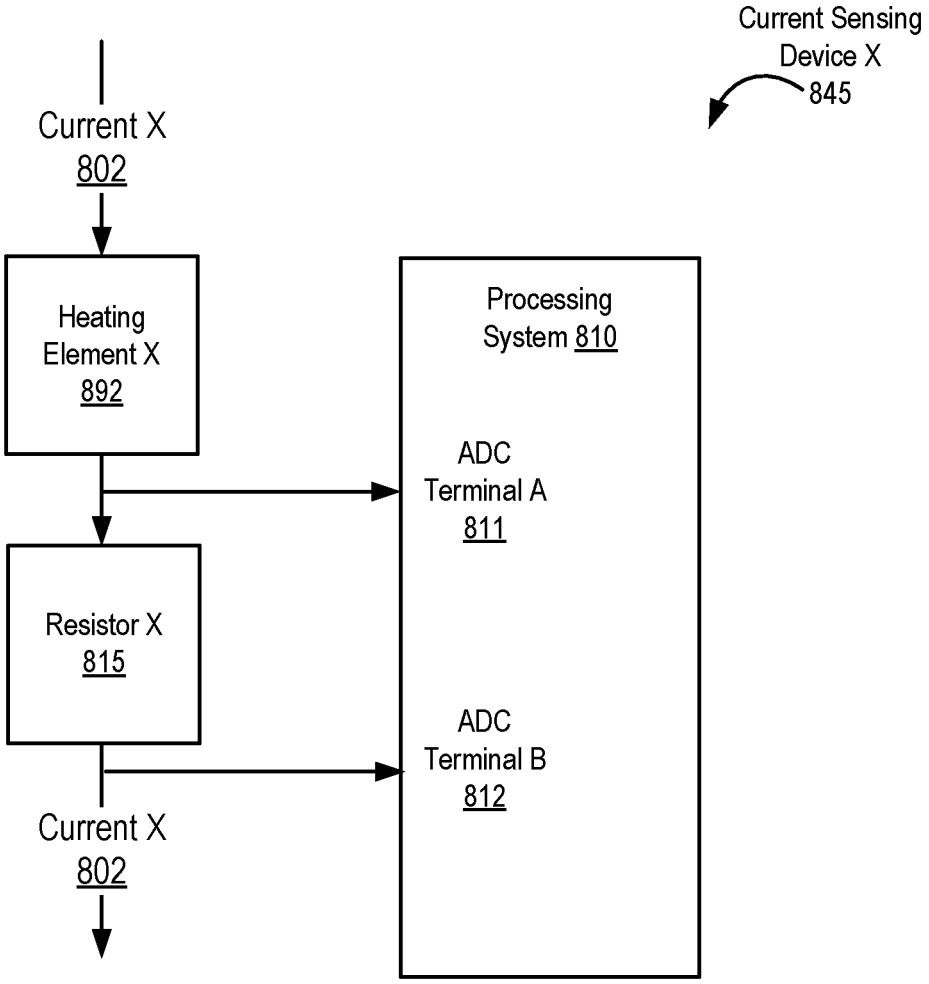

Turning to FIG. 8, FIG. 8 shows an example of a current sensing device in accordance with one or more embodiments. For example, as shown in FIG. 8, a current sensing device X (845) may include a processing system (810) coupled to a heating element X (892) located in an electronic vaping cartridge (not shown) and a resistor X (815). In particular, current X (802) flows through the heating element X (892) and the resistor X (815) back to a power source (not shown). Using voltage values obtained at analog-to-digital converter terminals (i.e., ADC terminal A (811), ADC terminal B (812)) in the processing system (810), the processing system can determine a value of the current X (802) flowing through resistor X (815). Based on the current X (802) flowing through the resistor X (815), the processing system can determine whether current leakage is occurring inside an electronic vaping power device or in an electronic vaping system.

In one or more embodiments, current sensing devices includes measuring current by evaluating current flows through the resistor, the processing system using sampling ports to measure a voltage (V) across a current sense resistor (R). The sampling function may be performed by the processing system or an external port could be utilized to perform the sampling function. During the sampling function, the measured current across the current sense resistor may be the same as the current flow through the heating element. The processing system may monitor the current flow. If the processing system detects current leakage or abnormally high or continuous current across the current sense resistor the processing system may terminate an electronic vaping operation or other operation performed within an electron vaping system. For example, an offset of two or more differential channels may be measured by selecting the same input for both negative and positive input. Offset calibration may be included as both the positive and negative input to the differential gain amplifier, the remaining offset in the gain stage and conversion circuitry can be measured directly as the result of the conversion. This value may be subtracted from subsequent conversions with the same gain setting to reduce offset error to below 1 Less Significant Bit (LSB).

Figure 9:
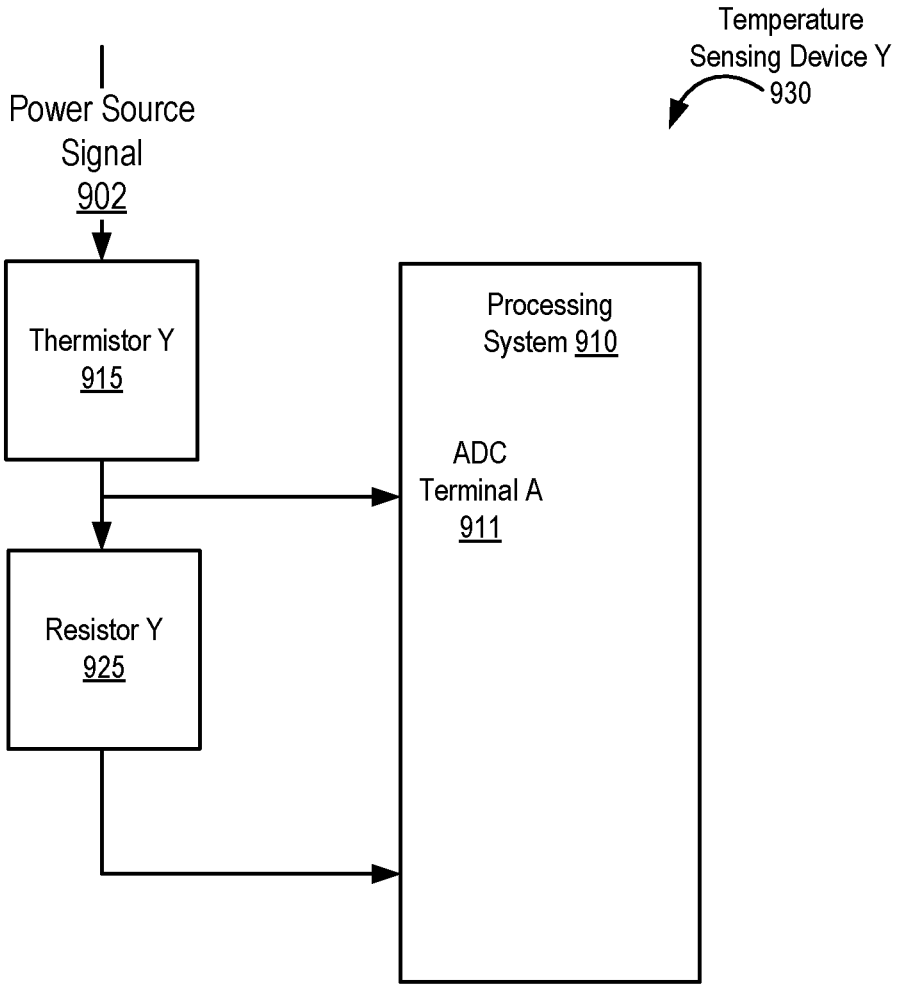

Turning to FIG. 9, FIG. 9 shows an example of a temperature sensing device in accordance with one or more embodiments. For example, as shown in FIG. 9, a temperature sensing device Y (930) may include a processing system (910) coupled to a thermistor Y (915) and a resistor Y (925). In particular, a power source signal (902) from a power source (not shown) in an electronic vaping power device may flow through the thermistor Y (915) and resistor Y (925) thus producing a temperature sensing signal obtained by the processing system (910). Using the temperature sensing signal obtained at an analog-to-digital converter terminals (e.g., ADC terminal A (911)) in the processing system (910), the processing system (910) can determine a temperature value proximate the thermistor Y (915). Likewise, based on the determined temperature value, the processing system (910) can determine whether one or more electronic components proximate the thermistor Y (915) or the electronic vaping system satisfy a predetermined temperature value.

Returning to FIG. 4, in Step 420, a determination is made whether a safety analysis is passed according to a predetermined criterion in accordance with one or more embodiments. For example, a processing system may compare the results from a safety analysis according to a predetermined criterion. This predetermined criterion may include threshold values or ranges of values that designate safe operating conditions. For example, predetermined criteria may correspond to liquid sensing signal values, temperature values, current sensing values, power source values, and various operating conditions of a power device circuit or other component of an electronic vaping system. Moreover, predetermined criteria may also include dynamic values that depend on different types of operating conditions of an electronic vaping power device. Likewise, different predetermined criteria may be associated with different locations and/or different electronic components in an electronic vaping system. Thus, one predetermined criterion may correspond a heating element, while another predetermined criterion may correspond to a power source. In response to a determination that the safety analysis satisfies the predetermined criterion, the process proceeds to Step 430. In response to a determination that the safety analysis fails to satisfy the predetermined criterion, the process proceeds to Step 440.

In Step 430, an electronic vaping operation is performed in accordance to one or more embodiments. In particular, a processing system may cause a power device circuit to supply heating element power to a heating element in an electronic vaping cartridge to heat liquid in a liquid container. Thus, the electronic vaping operation may produce a puffing event for a user operating an electronic vaping system.

In Step 440, one or more faults are determined in an electronic vaping power device based on a safety analysis according to one or more embodiments. For example, a processing system may calculate a difference between values sampled from various sensing devices in a safety analysis with a predetermined criterion to determine whether an anomaly has occurred. Faults may include indications of a presence of liquid, an amount of leakage current, overheating of a heating element, ambient temperature being outside acceptable operating range, a low battery voltage, an excessive battery discharge, heating element resistance outside a predetermined range, a pressure sensor failure, etc.

In Step 450, a determination is made whether one or more faults are temporary or permanent within an electronic vaping power device according to one or more embodiments. For example, some faults may dissipate after a certain amount of time (e.g., the electronic vaping power device may cool down when outside extreme environmental conditions abate). Some faults may be permanent based on malfunctioning electronic components and/or the components reach the end of a product life cycle. In response to a determination that the electronic vaping power device can be operated safely once one or more faults are corrected, the process proceeds to Step 460. In response to a determination that the electronic vaping power device cannot be operated safely, the process proceeds to Step 470.

In one or more embodiments, different components of an electronic vaping system correspond to different operating conditions. For example, one set of predetermined criteria may be designated for a heating element during an electronic vaping operation. Another set of predetermined criteria may be designated for a power source and a processing system during a sleep mode. In another example, a different set of predetermined criteria may be associated with a protection mode where the power device circuit operates with minimal functionality until one or more faults are resolved by the electronic vaping power device. The protection mode may continue until one or more safety analyses performed by a processing system are satisfied.

In Step 460, an electronic vaping power device is disabled until predetermined criterion is satisfied in accordance to one or more embodiments. For example, a processing system may wait until another activation signal before performing another safety analysis. Based on the additional safety analysis, the processing system may determine whether any detected faults in the electronic vaping system are still present or if they have been resolved. For example, in the event where a safety analysis indicates that the inside temperature of the electric vaping device is too high, the electronic vaping system may enter a sleep mode that restricts the restarting of electronic vaping operations to a point in time when the temperature has dropped.

In Step 470, an electronic vaping power device is disabled permanently in accordance with one or more embodiments. For example, after failing specific or multiple safety analyses, the processing system may determine that the electronic vaping power device is too dangerous to operate. In such event, the electronic vaping power device may enter a "kill" mode that renders the electronic vaping system inoperable and disables the electronic vaping power device permanently. In a "kill" mode, the power source in an electronic vaping power device will not charge or discharge.

Figure 5:
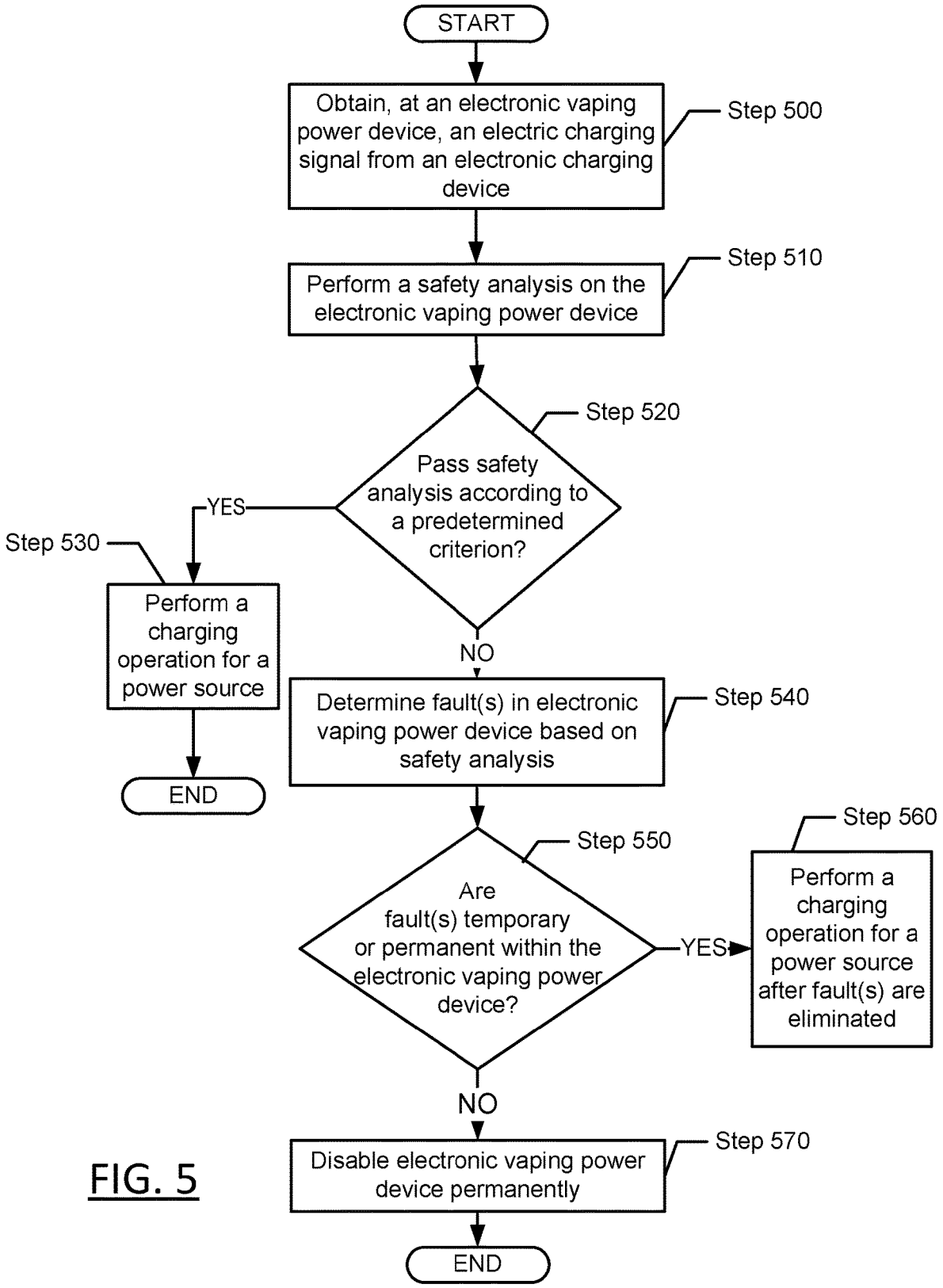

Turning to FIG. 5, FIG. 5 shows a flowchart in accordance with one or more embodiments. Specifically, FIG. 5 describes a method for performing one or more safety procedures in regard to charging operations of an electronic vaping power unit. The process shown in FIG. 5 may involve, for example, one or more components discussed above in reference to FIGS. 1-3 (e.g., processing system (210)). While the various steps in this flowchart are presented and described sequentially, one of ordinary skill in the art will appreciate that some or all of the steps may be executed in different orders, may be combined or omitted, and some or all of the steps may be executed in parallel. Furthermore, the steps may be performed actively or passively.

In Step 500, an electric charging signal is obtained at an electronic vaping power device from an electronic charging device in accordance with one or more embodiments. For example, the electric charging signal may be a signal conveyed via a mechanical or magnetic connection between an electronic charging device and an electronic vaping device.

In Step 510, a safety analysis is performed on an electronic vaping power device in accordance with one or more embodiments. For example, the safety analysis may correspond to one or more safety analyses described in FIGS. 6-9 and the accompanying description above.

In Step 520, a determination is made whether a safety analysis is passed according to a predetermined criterion in accordance with one or more embodiments. Step 520 may be similar to Step 420 described above with respect to FIG. 4 and the accompanying description. Likewise, the predetermined criterion may correspond to various charging parameters with respect to an electrical charging signal, e.g., voltage specification, amount of current, etc. In particular, the safety analysis may detect current leakage with respect to an electronic charging operation. In response to a determination that the safety analysis satisfies the predetermined criterion, the process proceeds to Step 530. In response to a determination that the safety analysis fails to satisfy the predetermined criterion, the process proceeds to Step 540.

In Step 530, an electronic charging operation is performed for a power source in accordance to one or more embodiments. For example, in response to satisfying one or more safety analyses, a processing system may cause one or more transistors to complete a circuit from an electric charging device to a power source in an electronic vaporing power device. The completed circuit may allow an electric charging signal to flow to the power source.

In Step 540, one or more faults are determined in an electronic vaping power device based on a safety analysis according to one or more embodiments. Step 540 may be similar to Step 440 described above with respect to FIG. 4 and the accompanying description.

In Step 550, a determination is made whether one or more faults are temporary or permanent within an electronic vaping power device according to one or more embodiments. In particular, any faults determined in an electronic vaping system may be compared with predetermined conditions of electric charging operations of a power source. In response to a determination that the electronic vaping power device can be charged safely, the process proceeds to Step 560. In response to a determination that the electronic vaping power device cannot be charged safely, the process proceeds to Step 570.

In Step 560, a charging operation is performed for a power source after one or more faults are eliminated in accordance with one or more embodiments. For example, after specific or multiple safety analyses are passed, the processing system may initiate charging operations in the power device circuit.

In Step 570, an electronic vaping power device is disabled permanently in accordance with one or more embodiments. Step 570 may be similar to Step 470 described above with respect to FIG. 4 and the accompanying description.

In general, in one aspect, embodiments relate to a system that includes a power device circuit. The system further includes a power source coupled to the power device circuit. The system further includes a current sensing device coupled to the power device circuit. The system further includes a processing system coupled to the power source, the current sensing device, and the power device circuit. The processing system controls heating element power using the power source. The heating element power operates a heating element in an electronic vaping cartridge. The current sensing device may be configured to transmit a current sensing signal to the processing system. The processing system uses the current sensing signal to determine that a current leakage is present in an electronic vaping power device.

In general, in one aspect, embodiments relate to a method for managing an electronic vaping power device. The method includes performing a safety analysis on a power device circuit. The power device circuit performs an electronic vaping operation. Performing the safety analysis includes using a current sensing device to determine whether a current leakage is present in the power device circuit. The method further includes disabling, in response to determining that the current leakage is present in the power device circuit, the power device circuit from performing the electronic vaping operation or a charging operation.

In general, in one aspect, embodiments relate to a system that includes a power device circuit. The system further includes a power source coupled to the power device circuit. The system further includes a temperature sensing device coupled to the power device circuit. The system further includes a processing system coupled to the power source, the temperature sensing device, and the power device circuit. The processing system controls heating element power using the power source. The heating element power operates a heating element in an electronic vaping cartridge. The temperature sensing device transmits a temperature sensing signal to the processing system. The processing system uses the temperature sensing signal to determine that a predetermined temperature is present in an electronic vaporing power device.

In general, in one aspect, embodiments relate to a method for managing an electronic vaping power device. The method includes performing a safety analysis on a power device circuit. Performing the safety analysis includes using a temperature sensing device to determine whether a predetermined temperature is present in the electronic vaping power device. The power device circuit performs the electronic vaping operation. The method further includes disabling, in response to determining that the predetermined temperature is present in the electronic vaping power device, the power device circuit from performing the electronic vaping operation.

In general, in one aspect, embodiments relate to a system that includes a power device circuit. The system further includes a power source coupled to the power device circuit. The system further includes a thermal cut-off device coupled to the power device circuit. The system further includes a processing system coupled to the power source, the thermal cut-off device, and the power device circuit. The processing system controls heating element power using the power source. The heating element power operates a heating element in an electronic vaping cartridge. The thermal cut-off device may form an open circuit that terminates the transmission of the heating element power in response to the thermal cut-off device determining a predetermined temperature.

In general, in one aspect, embodiments relate to a method for managing an electronic vaping power device. The method includes performing a safety analysis on a power device circuit. Performing the safety analysis includes using a thermal cut-off device to determine whether a predetermined temperature is present in the electronic vaping power device. The method further includes disabling, in response to determining that the predetermined temperature is present, the transmission of heating element power to an electronic vaping cartridge.

In general, in one aspect, embodiments relate to a system that includes a power device circuit. The system further includes a power source coupled to the power device circuit. The system further includes a protection circuit coupled to the power device circuit. The system further includes a processing system coupled to the power source, the protection circuit, and the power device circuit. The processing system controls heating element power using the power source. The heating element power operates a heating element in an electronic vaping cartridge. The processing system terminates permanently the operation of the power device circuit using the protection circuit in response to determining a permanent fault.

In general, in one aspect, embodiments relate to a method for managing an electronic vaping power device. The method includes performing a safety analysis on a power device circuit. The power device circuit performs an electronic vaping operation. The method further includes disabling, in response to determining that the fault is present in the power device circuit, the power device circuit from permanently performing the electronic vaping operation using a protection circuit coupled to a power source and the power device circuit.

Software instructions in the form of computer readable program code to perform embodiments of the invention may be stored, in whole or in part, temporarily or permanently, on a non-transitory computer readable medium such as a storage device, flash memory, physical memory, or any other computer readable storage medium. Specifically, the software instructions may correspond to computer readable program code that, when executed by a processor(s), is configured to perform one or more embodiments of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system, comprising:

a power device circuit;

a power source coupled to the power device circuit;

a liquid sensing device coupled to the power device circuit; and a processing system coupled to the power source, the liquid sensing device, and the power device circuit, wherein the processing system is configured to control a heating element power using the power source, the heating element power being configured to operate a heating element in an electronic vaping cartridge, and wherein the liquid sensing device is configured to transmit a liquid sensing signal to the processing system in response to determining that a liquid is present in the power device circuit, and wherein the liquid sensing device comprises:

an amplifier;

a plurality of conductive traces coupled to an input of the amplifier; and a resistor coupled to an output of the amplifier, wherein the amplifier is configured to generate the liquid sensing signal in response to a presence of the liquid producing a closed circuit with at least a portion of the plurality of conductive traces.

2. The system of claim 1, wherein the liquid sensing signal corresponds to a voltage output by the amplifier based on a current conducted through a portion of the plurality of conductive traces, and wherein the processing system is configured to cause the power device circuit to enter a protection mode in response to obtaining the liquid sensing signal.

3. The system of claim 1, further comprising:

a connector coupled to the power device circuit, wherein the connector is configured to mechanically or magnetically attach with an electronic charging device, a protection circuit coupling the connector and the power source, wherein the processing system is configured to cause the protection circuit to open in response to a determination by the processing system to permanently disable the power source.

4. The system of claim 1, further comprising:

a current sensing device coupled to the processing system and the power source, wherein the processing system is configured to use the current sensing device to measure an amount of current being transmitted through the heating element in the electronic vaping cartridge, and wherein the processing system terminates a control signal for the heating element in response to the amount of current exceeding a predetermined value.

5. The system of claim 1, further comprising:

a temperature sensing device coupled to the processing system, wherein the temperature sensing device is configured to detect an ambient temperature of a power device, and wherein the processing system is configured to prevent the power device circuit from performing an electronic vaping operation or a charging operation while the ambient temperature is outside a predetermined temperature range.

6. A system, comprising:

a power device circuit;

a power source coupled to the power device circuit;

a liquid sensing device coupled to the power device circuit;

a processing system coupled to the power source, the liquid sensing device, and the power device circuit, wherein the processing system is configured to control heating element power using the power source, the heating element power being configured to operate a heating element in an electronic vaping cartridge, and wherein the liquid sensing device is configured to transmit a liquid sensing signal to the processing system in response to determining that a liquid is present in the power device circuit;

a connector coupled to the power device circuit, wherein the connector is configured to mechanically or magnetically attach with the electronic vaping cartridge, and wherein the connector is configured to provide the heating element power between an electronic vaping cartridge and an electronic vaping device; and a thermal cut-off device coupled to the power device circuit, wherein the thermal cut-off device is configured to produce an open-circuit in the power device circuit that terminates transmission of the heating element power to the heating element.

7. The system of claim 6, wherein the thermal cut-off device couples the connector and the power source, and wherein the thermal cut-off device is configured to open when the thermal cut-off device is above a predetermined temperature.

8. A system, comprising:

an electronic vaping cartridge;

a power device circuit;

a power source coupled to the power device circuit;

a liquid sensing device coupled to the power device circuit;

a processing system coupled to the power source, the liquid sensing device, and the power device circuit, wherein the processing system is configured to control heating element power using the power source, the heating element power being configured to operate a heating element in the electronic vaping cartridge, wherein the liquid sensing device is configured to transmit a liquid sensing signal to the processing system in response to determining that a liquid is present in the power device circuit, and wherein the electronic vaping cartridge comprises at least one of the following:

a first liquid comprising a first substance, the first liquid being configured to be vaporized by the heating element during a first electronic vaping operation; or a second substance that is configured to be heated by the heating element to a predetermined temperature below a charring temperature of the second substance during a second electronic vaping operation; or a second liquid being coupled to a third substance, the second liquid being configured to be vaporized by the heating element into a vapor that is passed over the third substance during a third electronic vaping operation.

9. An electronic vaping power device, comprising:

a power source;

a power device circuit coupled to the power source, wherein the power device circuit is configured to perform an electronic vaping operation;

a processing system coupled to the power source and the power device circuit, wherein the processing system is configured to:

perform a first safety analysis on the power device circuit, wherein performing the first safety analysis comprises using a liquid sensing device to determine whether a liquid is present in the power device circuit, and disable, in response to determining that the liquid is present in the power device circuit, the power device circuit from performing the electronic vaping operation or a charging operation; and a protection circuit coupled to the power source, the power device circuit, and a connector, wherein the connector is configured to couple to an electronic charging device or an electronic vaping cartridge, wherein the protection circuit is configured to terminate power to the power device circuit from the power source in response to a signal from the processing system.

10. The electronic vaping power device of claim 9, wherein the processing system is further configured to:

perform a second safety analysis on the power device circuit, wherein the second safety analysis comprises using a temperature sensing device to determine whether the power device circuit is outside a predetermined temperature range of the power source; and disable, in response to determining that the power device circuit is outside the predetermined temperature range, the power device circuit from performing the electronic vaping operation or a charging operation.

11. The electronic vaping power device of claim 9, wherein the processing system is further configured to:

perform a second safety analysis on the power device circuit, wherein the second safety analysis comprises using a current sensing device to determine whether a current leakage is occurring within the electronic vaping power device; and disable, in response to determining that current leakage is present in the power device circuit, the power device circuit from preforming the electronic vaping operation or a charging operation.

12. The electronic vaping power device of claim 9, wherein the processing system is further configured to:

determine that a fault exists in the power device circuit;

determine, in response to determining that the fault exists, whether the power device circuit can be operated according to a predetermined criterion; and disable the power device circuit permanently in response to determining that the power device circuit cannot be operated according to the predetermined criterion.

13. The electronic vaping power device of claim 9, wherein the processing system is configured to obtain a request to initiate electronic vaping operations in response to a pressure input by a user to a pressure sensor, an activation by a switch, a contact to a button, or a user input to one or more touchpads.

* * * * *